United States Patent [19]

Martin et al.

[11] Patent Number: 4,864,747

[45] Date of Patent: Sep. 12, 1989

[54] SUPPORT ASSEMBLY FOR A DRAGLINE BUCKET

[75] Inventors: Paul F. Martin, LaGrange Park; Carl D. Swick, Lockport, both of Ill.

[73] Assignee: Harnischfeger Corporation, Brookfield, Wis.

[21] Appl. No.: 162,146

[22] Filed: Feb. 29, 1988

[51] Int. Cl.[4] ..... E02F 3/46

[52] U.S. Cl. ..... 37/115; 414/142.9

[58] Field of Search ..... 37/115–117; 414/143

[56] References Cited

U.S. PATENT DOCUMENTS

| | | | |
|---|---|---|---|
| 739,933 | 9/1903 | Sieurin | 414/143 |
| 958,158 | 5/1910 | Negley | 37/115 |
| 976,742 | 11/1910 | Martinson | 37/116 |
| 1,105,480 | 7/1914 | Bager | 37/116 |
| 1,208,348 | 12/1916 | Miller | 37/116 |
| 1,508,639 | 9/1924 | Beach et al. | 37/115 |
| 1,560,895 | 11/1925 | Crowe | 37/115 |
| 2,588,657 | 3/1952 | Pitts | 37/115 |
| 4,731,941 | 3/1988 | Beatty | 37/115 |

FOREIGN PATENT DOCUMENTS

| | | | |
|---|---|---|---|
| 1257140 | 9/1986 | U.S.S.R. | 37/116 |

*Primary Examiner*—Eugene H. Eickholt

*Attorney, Agent, or Firm*—Richard C. Ruppin

[57] ABSTRACT

A support assembly for a drag bucket includes lift lines and pull lines, each secured to a respective link plate pivotably secured to opposite sides of the bucket. Stops on the bucket side walls limit pivoting of the plates, whereby the bucket can selectively be maintained upright or in a dumping position by control of the lines.

16 Claims, 1 Drawing Sheet

SUPPORT ASSEMBLY FOR A DRAGLINE BUCKET

TECHNICAL FIELD

The present invention relates to dragline buckets designed for excavating, digging, scraping, dragging, and the like, and more specifically to the support assembly for a dragline bucket.

BACKGROUND OF THE INVENTION

Dragline buckets are used to move earth in, for example, strip mining operations. In such operations, buckets are suspended from cranes or the like by a lift line, and are manipulated by the lift lines and other control lines so as to dig earth from one location and then move the earth-filled bucket to another location where it is dumped. Because of the size and cost of the machinery involved, it is highly desirable to obtain maximum use of the machinery in order to achieve maximum cost efficiency.

Support for such buckets has conventionally been provided by mounting arrangements such as shown in U.S. Pat. No. 3,247,606. Such mounting arrangements, or "hitches", use essentially three lines connected to the bucket: the lift line, the dump line, and the bridle chain.

Such conventional hitches are subjected to large stresses, requiring frequent replacement when the lines break. Replacement can be time consuming in view of the number of lines involved in the hitch, and thus replacement can hinder the cost effective use of the machinery.

The present invention is directed toward overcoming one or more of the problems set forth above.

SUMMARY OF THE INVENTION

In one aspect of the present invention, a support assembly for a drag bucket is provided including a lift line and a pull line. A pair of link plates are pivotably secured to opposite sides of the bucket, and stops on the bucket side walls limit pivoting of the plates. The pull line and the lift line are secured to each of the plates, whereby the bucket can selectively be maintained upright or in a dumping position by control of the two lines.

The support assembly of the present invention eliminates the need to have both a dump line and a bridle chain connected to the pull line. Elimination of the second line speeds the task of changing lines as is required due to wear, and thereby minimizes down time.

DESCRIPTION OF THE PREFERRED EMBODIMENT

Figure 1:
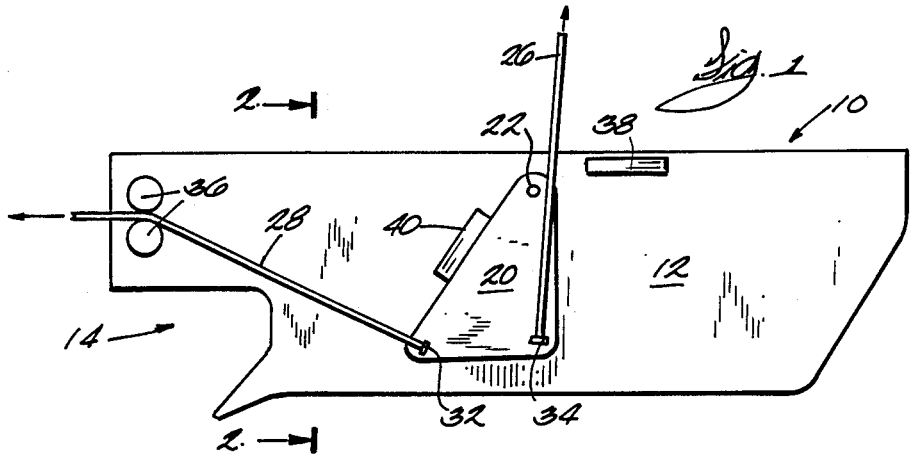
FIG. 1 is a side view of a bucket supported by the support assembly in its digging or earth moving position.
Figure 2:
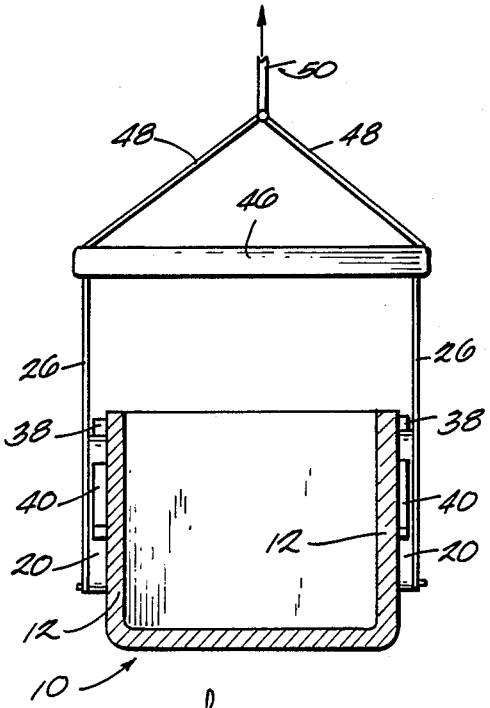
FIG. 2 is a cross-sectional view taken along line 2—2 of FIG. 1.

A dragline bucket 10 having a pair of side walls 12 and an open forward end 14 is shown in FIGS. 1 and 2 supported by the present invention in its digging or earth moving position. Although the dragline bucket 10 shown in FIGS. 1 and 2 is of the archless type, it is understood that it may be of the arch-type (not shown) wherein an arch spans across the front end of the bucket for support.

The support assembly includes a pair of link plates 20 pivotably secured to opposite bucket side walls 12 by coaxial pivots 22 (note that the support assembly is identical on both sides of the bucket 10, and for ease of reference, matching pairs of components have herein been identified by the same reference numeral). Lift lines 26 and pull lines 28 are each secured to the link plates 20 by suitable coaxial mounts 32, 34, with the pull line mounts 32 being forward of the lift line mounts 34. Suitable pulleys or guides 36 are provided on the forward end of the bucket 10 to guide the pull lines 28.

Suitable stops 38,40 (such as, e.g., metal welded blocks) are secured to the bucket side walls 12 in order to limit pivoting of the link plates 20 to allow for control of the bucket 10 as will become apparent.

As shown in FIG. 2, the lift lines 26 are connected at their upper end to a bail 46 connected to a pair of cables 48 which in turn are connected to a lift cable 50. The pull lines 28 may be similarly secured to a pull cable (not shown). Both the lift and pull cables are controlled by a crane or the like.

In the preferred method of operation, the bucket 10 is dragged over the earth by the pull lines 28 until the interior of the bucket 10 is loaded with dug earth. The lift cable 50 and lift lines 26 are then used to lift the entire bucket 10 in order to clear it from obstacles as it is swung (by the supporting crane) to the location where the earth is to be dumped. The combination of the tension of the lift lines 26 and the pull lines 28, together with the weight of the loaded bucket 10 acting effectively at its center of gravity, create a net moment force around the coaxial pivots 22 which keeps the link plates 20 against the stops 40 as shown in FIG. 1.

Figure 3:
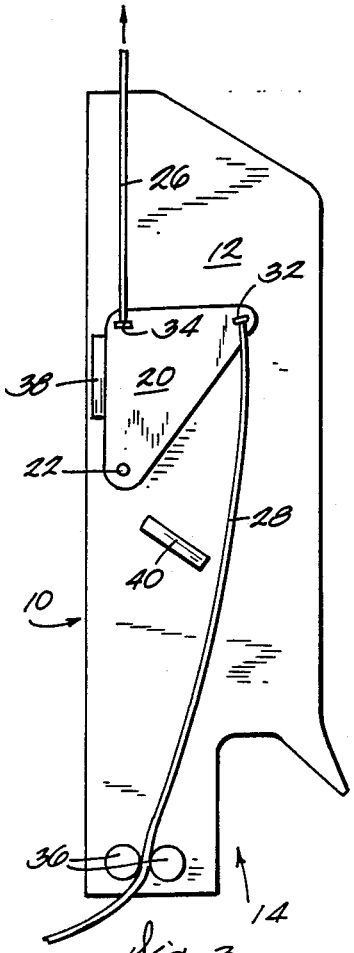
FIG. 3 is a side view of the bucket of FIG. 1 but in its dumping position.

When the bucket 10 is to be dumped, the pull lines 28 are slacked, causing the opposing moment exerted on the link plates 20 by the lift lines 26 to be to be greater than the moment exerted by the pull lines 28. This causes the link plates 20 to pivot to the position shown in FIG. 3 against the other stops 38, which causes the bucket 10 to dump. This change in net moment results not only from the different forces exerted by the lines 26, 28, but also from the change in orientation of the lines 26, 28 as the bucket 10 moves. The change in orientation of the lines 26 and 28 causes their forces to act on the bucket at coaxial pivots 22 through different moment arms which change relative to the moment arm of the center of gravity of the loaded bucket. Thus, the force of the pull lines 28 on the bucket 10 through the link plates 20 and the stops 40 decreases or ceases entirely, and the lift lines 26 at their coaxial mounts 34 will move toward stops 38 and thus to a different orientation having a longer moment arm about the coaxial pivots 22. This longer moment arm of the lift lines 26 at their coaxial mounts 34 is an increase relative to the moment arm of the center of gravity of the loaded bucket 10 about the coaxial pivots 22 and causes dumping force on the loaded bucket.

When dumping is completed, the bucket 10 is moved back to the location where digging is being done, and is dropped for another cycle of digging.

As will be apparent to a skilled artisan with an understanding of the above, the above described support assembly will eliminate the third line found in conventional support assemblies thereby minimizing the cost of replacement as well as the down time required for such replacements.

Other aspects, objects, and advantages of the present invention can be obtained from a study of the specification, drawings and appended claims.

We claim:

1. A support assembly for earth excavating dragline bucket means controlled by the forces of lift line means and pull line means, said bucket means having a pair of opposite side walls with an open forward end, a carrying position, and a dumping position, comprising:

a pair of movable means secured to the opposite bucket side walls, the lift line means and the pull line means each being attached to the pair of movable means, for applying the forces of the lift and pull line means to the bucket means and moving the lift and pull line means between a first and a second position respectively corresponding to the carrying and the dumping position of the bucket means and at which positions said forces are applied to the bucket means; and the bucket means is movable from the carrying position toward the dumping position in response to movement of the lift and pull line means toward their second position and the application of the force of the lift line means to the bucket means 2. The support assembly of claim 1 wherein the pull line means is attached to the pair of movable means for pulling the bucket means during loading of the bucket means and holding the bucket means in the carrying position during lifting of the bucket means.

3. The support assembly of claim 1 wherein the pair of movable means comprises a pair of coaxial pivots each mounted on an opposite bucket side wall and a pair of link plates each secured to one of the pivots and each pivotable about said one of the pivots to move said lift and pull line means between said first and second positions.

4. The support assembly of claim 3 wherein the pull line means is attached to the pair of link plates for pulling the bucket means during loading of the bucket means and holding the bucket means in the carrying position during lifting of the bucket means.

5. A support assembly for earth excavation bucket means controlled by the forces of a lift line, a pull line and the weight of the loaded bucket means acting at its center of gravity, the bucket means having a pair of opposite walls with an open forward end, comprising:

a pair of movable means secured to opposite bucket side walls and each having a lift mount at which the lift line is attached to the pair of movable means and a pull mount at which the pull line is attached to the pair of movable means for applying the forces of the lift and pull lines to the bucket means and moving the lift and pull mounts from first toward second positions at which the forces of the lift and pull lines are applied to the bucket means;

the bucket means having a carrying position at which the forces of the lift and pull lines are applied to the bucket means at their first positions and the weight of the loaded bucket means is applied to the bucket means through said center of gravity; and the bucket means is movable from the carrying position toward a dumping position in response to movement of the lift mounts toward their second position and the application of the force of the lift line to the bucket means.

6. The support assembly of claim 5 wherein the lift mounts move toward their second position relative to the center of gravity of the loaded bucket.

7. The support assembly of claim 6 wherein the bucket means is movable from the carrying position toward the dumping position in response to release of the force of the pull line on the bucket means.

8. The support assembly of claim 5 further comprising:

first and second stops affixed to each bucket side wall; and wherein the pair of movable means engage the first stops when the bucket means is in the carrying position and the pair of movable means engage the second stops when the bucket means is in the dumping position.

9. The support assembly of claim 8 wherein the lift mounts on the pair of movable means are coaxial with each other and the pull mounts on the pair of movable means are coaxial with each other.

10. The support assembly of claim 9 wherein the pair of movable means comprises a pair of coaxial pivots each mounted on an opposite bucket side wall and a pair of link plates each pivotably secured to one of the pivots to move the coaxial lift and pull mounts between their first and second positions.

11. A support assembly for a dragline bucket controlled by a lift line and a pull line during earth excavation whereby the bucket is loaded with earth, said bucket having a pair of opposite side walls with an open forward end, comprising:

a pair of movable means each secured to an opposite bucket side wall at a securement location on each said wall and movable from a first position toward a second position;

a pair of pull mounts each mounted on one of the movable means, the pull line being secured at the pull mounts to the pair of movable means, and a pair of lift mounts each mounted on one of the movable means, the lift line being secured at the lift mounts to the pair of movable means;

the loaded bucket has a weight including a center of gravity and a weight moment arm acting at the center of gravity about said securement locations of the pair of movable means;

the lift line has a moment arm between the lift mounts and the securement locations and acting about said securement locations;

the bucket is movable between a carrying position at which the pair of movable means are in their first position and a dumping position at which the pair of movable means are in the second position; and the lift mounts are movable with the pair of movable means from a first position corresponding to the first position of the pair of movable means toward a second position corresponding to the second position of the pair of movable means such that the lift line moment arm is increased relative to the weight moment arm whereby movement of the bucket to its dumping position is initiated.

12. The support assembly of claim 13 wherein the movement of the lift mounts from their first position toward their second position is relative to the center of gravity of the bucket.

13. The support assembly of claim 12 wherein said movement of the lift mounts is parallel to the bucket side walls.

14. A support assembly for a dragline bucket controlled by a lift line and a pull line during earth excavation whereby the bucket is loaded with earth, said bucket having a pair of opposite side walls with an open forward end comprising:

a pair of movable means each secured to an opposite bucket side wall at a securement location on each said wall and movable from a first position toward a second position;

a pair of coaxial pull mounts each mounted on one of the movable means, the pull line being secured at the coaxial pull mounts to the pair of movable means, and a pair of coaxial lift mounts each mounted on one of the movable means, the lift line being secured at the coaxial lift mounts to the pair of movable means;

the loaded bucket has a weight including a center of gravity and a weight moment arm acting at the center of gravity about said securement locations of the pair of movable means;

the lift line has a first moment arm acting at the coaxial lift mounts about said securement locations when the pair of movable means are in their first position and a second moment arm acting at the coaxial lift mounts about said securement locations and increasing relative to the weight moment arm of the loaded bucket when the pair of movable means move toward their second position;

the loaded bucket having a carrying position when the lift line acts through its first moment arm and the weight of the loaded bucket acts through the weight moment arm; and the loaded bucket is movable toward a dumping position when the lift line acts through its second increasing moment arm and the weight of the loaded bucket acts through the weight moment arm.

15. The support assembly of claim 14 wherein the pair of movable means comprises a pair of coaxial pivots each mounted on an opposite bucket side wall and a pair of link plates each pivotally secured to one of the pivots for movement between said first and second positions.

16. The support assembly of claim 15 further including a guide on both side walls of the bucket and at the forward end thereof, the pull line running through each guide.

* * * * *